United States Patent [19]

Vock

[11] 4,043,985

[45] Aug. 23, 1977

[54] TIRE MONOFILAMENTS

[75] Inventor: Günther Vock, Strassberg, Germany

[73] Assignee: Hoechst Aktiengesellschaft, Frankfurt am Main, Germany

[21] Appl. No.: 725,133

[22] Filed: Sept. 17, 1976

Related U.S. Application Data

[60] Division of Ser. No. 484,162, June 28, 1974, Pat. No. 3,998,920, which is a continuation of Ser. No. 313,533, Dec. 8, 1972, abandoned.

[30] Foreign Application Priority Data

Dec. 14, 1971 Germany ..... 2161967

[51] Int. Cl.[2] ..... C08G 63/12

[52] U.S. Cl. ..... 260/75 T; 152/359

[58] Field of Search ..... 264/210 F, 290 T; 260/75 T; 152/359; 57/140

[56] References Cited

U.S. PATENT DOCUMENTS

| | | | |
|---|---|---|---|
| 2,615,784 | 10/1952 | McClellan | 8/130.1 |
| 3,216,187 | 11/1965 | Chantry et al. | 264/176 |
| 3,361,859 | 1/1968 | Cenzato | 264/176 F |
| 3,413,797 | 12/1968 | Chapman et al. | 57/140 |
| 3,419,060 | 12/1968 | Goy | 152/359 |
| 3,429,354 | 2/1969 | Brooks | 152/357 |
| 3,838,561 | 10/1974 | Munting | 264/290 T |
| 3,998,921 | 12/1976 | Kohler et al. | 264/210 F |

FOREIGN PATENT DOCUMENTS

| | | |
|---|---|---|
| 42-21298 | 10/1967 | Japan |
| 1,435,699 | 3/1969 | Germany |
| 883,644 | 12/1961 | United Kingdom |

*Primary Examiner*—Jay H. Woo

*Attorney, Agent, or Firm*—Connolly and Hutz

[57] ABSTRACT

Polyester monofilaments having very high strength and low elongation also at elevated temperature and being resistant against tire rubber are obtained from polyesters having an intrinsic viscosity of more than 0.67 and terminal carboxy groups of less than 25 milliequivalents/kg by spinning into a water bath, a first drawing in a water bath having a temperature of from 70° to 100° C in a ratio of from 1 : 4.0 to 1 : 6.0, a second drawing at a temperature being a maximum 15° C below the melting point to attain a total drawing ratio of from 1 : 6.0 to 1 : 7.5, and subsequent setting at a temperature being a maximum 15° C below the melting point without allowing a shrinkage.

1 Claim, No Drawings

TIRE MONOFILAMENTS

This application is a division of application Ser. No. 484,162 filed June 28, 1974, now U.S. Pat. No. 3,998,920, which is a continuation of application Ser. No. 313,533 filed Dec. 8, 1972 now abandoned.

The present invention relates to an improved low shrinkage monofilament made from high molecular linear polyesters, especially from polyethylene terephthalate, which monofilament may be employed as tire cord, and a process for the manufacture thereof.

For the manufacture of reinforcing fabrics for conveyor belts or tires, yarns made from endless filaments having a great number of monocapillaries are used, which for example may be obtained from high molecular weight polyesters. Such polyester cords have proved to be very useful for the manufacture of tire carcases. For the manufacture of the belt of belted tires, however, which has to possess special dimension stability, a polyester cord is too flexible and too soft. There are quite extraordinary requirements for the reinforcing layer in the belt of a belted tire:

The materials to be used must have a very high strength and a low elongation, which properties must be maintained also at elevated temperature (running temperature of the tire); furthermore they must be distinguished by low shrinkage values and high resistance against the usual rubber chemicals. In the case of strain due to bending, compression and impact, stiff monofilaments are more suitable than multifilaments. Efforts are therefore made in this field to replace the soft multifiber cords by stronger monofilaments, which are more advantageous in that the required stability of the belt can be achieved by a considerably reduced number of fabric layers, thus substantially improving the properties of the belted tire. Also the use of metal filaments in the belt permits the manufacture of stable belts containing only few fabric layers, and such belted tires are already produced on a very large scale.

Thus, for example, British patent specification Nos. 894,706 and 989,498 describe the manufacture of belted tires from steel fibers and indicate also the use of polyester monofilaments in this connection. It is generally known that belted tires can be manufactured from steel wires which tires have an extraordinary dimension stability and thus possess the most important property required for a tire belt. Nevertheless, on account of their hardness and rigidity, which make driving uncomfortable, it is tried to replace the steel cord by other cords, since more smoothness of driving, in the case of adhering to the steel belted tire, can only be achieved by an expensive design of the belt. Though the cited patents mention the use of polyester monofilaments, neither their manufacture is described nor the properties the monofilaments have to possess for this application are mentioned.

The same goes for British patent specification No. 883,644, which describes a reinforcing fabric for tires manufactured from monofilaments of synthetic high polymers, for example from nylon or from polyester.

Also U.S. Pat. No. 3,419,060 dealing with the manufacture of tire cord from polyester filaments or monofilaments discloses only that these filaments should advantageusly be drawn at a temperature near the melting point, in order to improve their strength.

U.S. Pat. No. 3,429,354 claims a cord consisting of a polyester monofilament, around which a multifilament yarn is wound in order to faciliate the adhesion to rubber. This polyester core monofilament is said to be a commercial monofilament, and its manufacturing conditions are not indicated.

All cited patents have these facts in common: the use of polyester monofilaments as tire cords is known, but it is not disclosed how such monofilaments are obtained and what special properties they have to possess for this type of application.

For cords of multicapillary polyester only, the manufacturing conditions are known and sufficiently described in the patent literature.

For example, Japanese patent application Sho 42-21298 describes the manufacture of polyester filaments having high strength, which can be processed to tire cord, and recommends a two-step drawing of these filaments, first at a temperature of from 120° to 180° C and then from 150° to 200° C; finally they have to be set at a temperature of from 130° to 200° C; a shrinkage of less than 10 % being admissible.

A special thermal treatment for improving the properties of polyester yarns for tire cord is described in German Offenlegungsschrift No. 1,435,699. Continuous multifilaments made from polyethylene terephthalate or aromatic polyamides are subjected to a thermosetting in a moving bed in order to reduce the residual shrinkage. Since they are multifilament yarns of a fine filament titer, they are easily heatable, and their residence time in the thermal treatment zone may be prolonged by multiple deflection. By this extremely intense heat treatment, which is possible only in the case of monocapillaries of fine titer, yarns having especially good textile properties, above all high strength, can be obtained.

However, it is impossible to use such a process which is specially developed for multifilaments for the manufacture of thick monofilaments being substantially stiffer. Thus, any deflection of these monofilaments risks to cause damages, such as compression, transverse or longitudinal grooving and marring, which make them unfit for use. A homogeneous heating of thick monofilaments to the required high temperatures within the short period of time which can be disposed of presents considerably more technical problems than that of thin filaments, and it requires other means and special equipment if the monofilament has to be uniformly heated over its complete cross-section. Also the textile data are different in the case of monofilaments. Favorable values obtainable in the case of multifilaments cannot be achieved in the case of high-tenacity monofilaments even under optimum cconditions. For, utmost homogeneity of the structure is the condition for the desired high strength at low elongation (steep stress-strain diagram), which conditions cannot be realized in the case of coarse filament titers.

Most patents the inventions of which relate to a process for the manufacture of thick monofilaments, i.e. "wires" or bristles, from polyester do only claim single process steps without any importance for the present invention, such as deflection of the monofilament in the spinning bath at determinted temperatures or by special devices, and the like.

A patent which describes in a more detailed manner the manufacture of strong monofilaments of polyethylene terphthalate is U.S. Pat. No. 2,615,784. However, the invention relates to bristles which of course have to possess technological properties different from a tire monofilament, and therefore the manufacturing conditions are also different. At first, a two-step drawing at temperatures of from 55° to 80° C and from 30° to 130° C is carried out, then a shrinkage of from 5 to 10% is given to the filament in water of 100° C, and subsequently it is heated to 150° to 250° C with simultaneous drawing.

It is therefore one object of the present invention to provide a reinforcing material for belted tires without the aforementioned drawbacks inherent in steel cord, i.e. uncomfortable driving and riding, but distinguished by the dimension stability required for a tire belt. Another object of this invention is to replace the soft multicapillary cord by a stiffer material which allows to impart the necessary quality to the belt through using only few layers of fabric, and which ensures simultaneously the smooth and comfortable driving properties brought about hitherto by the known cord made from synthetic high-tenacity continuous filaments or rayon. Therefore, it is a further object of this invention to provide a polyester tire monofilament which is distinguished by the cited good properties of both steel and multifilaments, i.e. a polyester monofilament having good resistance against rubber chemicals, which is stiffer than the multicapillary polyester cord and which excels by lack of elongation and low thermoshrinkage, and to provide also a process for the manufacture thereof.

The above objects of the invention are attained by spinning of a highly viscous polyester raw material having an intrinsic viscosity of more than0.67, preferably of from 0.74 to 0.88, and a content of terminal carboxy groups of less than 25, preferably less than 10 milliequivalents/kg, into a water bath, by two-step drawing and subsequent thermosetting thereof. The monofilament is first predrawn in a water bath at a temperture of from 70° to 100° C, preferably of from 85° to 95° C, in a ratio of from 1 : 4.0 to 1 : 6.0, preferably of from 1 : 4.5 to 1 : 5.5; subsequently after-drawn up to a total ratio of from 1 : 6.0 to 1 : 7.5, preferably from 1 : 6.2 to 1 : 7.0, with heating to a temperature near the melting point which may be up to 15° C at the utmost, preferably up to 10° C, below the melting point of the polyester; and finally heated to a temperature near the melting point, or up to 15° C at the utmost, preferably up to 10° C, below this melting point, while allowing either no shrinkage at all or a shrinkage below 5.0%, preferably below 3.0%.

The polyester monofilament obtained according to this process of the invention has an intrinsic viscosity of more than 0.64, preferably of from 0.71 to 0.84, a content of terminal carboxy groups below 30 milliequivalents/kg, preferably below 15 milliequivalents/kg, a diameter of from 0.20 to 0.55 mm, preferably from 0.30 to 0.40 mm, a specific strength of 60 g/tex, preferably from 60 to 80 g/tex, an elongation at break of from 6.0 to 15.0%, preferably from 8.0 to 12%, an elongation at the specific load of 27 g/tex of less than 6.0%, preferably of from 3.0 to 4.5%, and a thermoshrinkage measured at 160° C which is below 8.0%, preferably below 6.0%.

Suitable raw materials for the process of the invention are all high-melting filament- and thus also monofilament-forming polyesters, especially those containing at least 80% of ethylene terephthalate units. The remaining dicarboxylic acid and diol components of these (co-)polyesters are the cocomponents usually employed in the manufacturing processes of drawn polyester structures, for example isophthalic, p,p'-diphenyl-dicarboxylic, p,p'-diphenyl-methyl-dicarboxylic, p,p'-diphenylsulfo-dicarboxylic acid, all naphthalene-dicarboxylic acids possible, hexahydroterephthalic, adipic, sebacic acid, and the like. Polyethylene terephthalate is the most preferred polyester.

The polyester raw materials used in accordance with the invention should have a high intrinsic viscosity of at least 0.67, preferably of more than 0.74. These high viscosity values can be attained by means of known methods, for example concensation in the melt, an additional after-condensation in the melt with or without condensation promotors, or after-condensation in the solid state; the attainable viscosity increasing in the sequence as indicated. The intrinsic viscosities are measured as defined in example 1.

Furthermore, the high molecular weight polyesters used as raw material should be distinguished by a low content of free terminal carboxy groups which, as is known in the case of polyester tire cord, imparts to them an increased resistance against the action of moisture, high temperature, hydrolysis, rubber and the chemicals used for the incorporation into rubber. In the range of the preferred viscosities, the low content of terminal carboxy groups may be achieved in known-manner by solid state condensation or by terminal group sealing in the melt or in solid state by means of monofunctional epoxides, isocyanates, diazo-methane and other substances.

Spinning has to be carried out in such a manner that the properties of the raw material as described, which are necessary for a successful manufacturing process, ar maintained as far as possible in the finished polyester monofilament.

In the process of the invention, the monofilament spun into a water bath is drawn in two steps in order to achieve high strength. The first drawing is carried out in a water bath at a relatively low temperature of from 70° to 100° C, the second drawing, however, at a temperature just below the melting point of the polyethylene terephthalate or the corresponding copolyester.

Suitable heating means for the second drawing operation are therefore baths containing high-boiling inert liquids whichcan be easily removed from the surface of the monofilament, metal baths, ball beds, hot air, infrared or high frequency chambers.

For the operation mode of this process step it is important that the monofilament is heated as rapidly and homogeneously as possible to the required high temperature. This causes a low drawing tension which ensures a high drawing ratio and thus the attainment of the intended textile data. Anyway, devices through which the monofilament may pass without deflection are to be preferred, since the temperatures near the melting point of the polymer required for this process step cause a softening of the surface of the monofilament which renders it extremely sensitive to mechanical strain by bending, which strain results in deformation by compression and other damages.

A further important step for the obtention of a high quality polyester tire monofilament is the setting of the monofilament, which has to be carried out in such a manner that the high strength and low elongation values attained in the drawing operation are maintained with simultaneous decrease of the residual shrinkage. In order to achieve this, the setting in accordance with the invention is carried out at a temperature just below the melting point of the polyester with a residence time as long as possible and at high tension, i.e. no shrinkage or only a slight one is allowed. Since a long residence time often cannot be realized in industrial practice for reasons of profitability, the heating means used should be a very good heat conductor. Therefore, the devices already employed for the second drawing may be reused also for the setting operation of the process of the invention.

It has been observed that, on account of the poor thermal conductivity of a monofilament having the required diameter, a great part of the determined residence time is already consumed in the start heating phase of the setting process step. In a preferred embodiment of the process of this invention, setting is therefore immediately following the second drawing step, so that a cooling of the monofilament is avoided and heat losses are kept as low as possible. In industrial practice this can be achieved by shortening and protecting the distance between the drawing and the setting chamber. In a further preferred embodiment of the process of this invention, the draw-off device, which is situated between the second drawing and the setting equipment, is heated and optionally screened in order to avoid heat losses. In the case of appropriate dimensioning of the equipment, a third embodiment of this invention is advantageous which combines both process steps, so that the second drawing and the setting are carried out in the same heating chamber without any intermediate conveying device.

The polyester monofilament of the invention is suitable as reinforcing material for conveyor belts, power transmission belts, and above all for the manufacture of belts for belted tires. Because of the special properties of the raw material used it is resistant against the action of hydrolysis and heat and against the damaging effect of rubber chemicals. It combines the good properties of the hitherto known steel wires, above all their dimension stability and lack of elongation, and the properties of comfortable driving which until now only multicapillary cords made from rayon, polyamides or polyesters did possess. On the other hand, it avoids all drawbacks inherent in these hitherto known products, i.e. the two low dimension stability of the cords preventing their use in belted tires, and the uncomfortable driving (very hard rolling) due to steel tire wires. Moreover, belted tires having a steel reinforcement in contrast to those having a polyester reinforcement cannot be retreaded, but have to be burnt or submerged in the sea, so that they will become a progressively embarassing garbage problem. Thus, the polyester tire monofilament of the invention presents quite substantial technical advantages over the reinforcement materials hitherto known. The following examples illustrate the invention.

EXAMPLE 1

A polyethylene terephthalate raw material having an intrinsic viscosity of 0.81 (measured at 25° C in a mixture of phenol/tetrachloroethane in a weight ratio of 3 : 2) and a content of terminal carboxy groups of 5.0 milliequivalents/kg is spun at 280° C into a water bath by means of a screw extruder, and drawn off at a speed of 10 m/minute. The monofilament is drawn at 85° C in a second water bath in a ratio of 1 : 4.9, and drawn at 260° C (measured in the air space) in an infrared chamber having a length of 7.5 m, in order to achieve a total drawing ratio of 1 : 6.5. Subsequently, the monofilament is thermoset in a second infrared chamber having a length of 7.5 m, also at 250° C (measured in the air space), while allowing a shrinkage of 1.5%; thus imparting to the monofilament the desired final diameter of 0.30 mm.

The monofilament obtained has the following textile data:

| | |
|---|---|
| strength | 72 g/tex |
| elongation at break | 10.8% |
| elongation at the specific load of 27 g/tex | 3.3 % |
| shrinkage at 160° C | 5.1 % |
| force of shrinkage at 120° C | 300 g |
| intrinsic viscosity | 0.77 |
| terminal carboxy groups | 8.7 milliequivalents/kg |

EXAMPLE 2

A raw material according to Example 1 is processed as described in Example 1. The draw-off speed, however, is 15 m/minute; the total drawing ratio 1 : 6.45 and the shrinkage allowed in the thermosetting operation is 2.0%.

The monofilament obtained has the following textile data:

| | |
|---|---|
| diameter | 0.30 mm |
| strength | 71 g/tex |
| elongation at break | 10.3% |
| elongation at the specific load of 27 g/tex | 3.4% |
| shrinkage at 160° C | 5.9% |
| force of shrinkage at 120° C | 300 g |
| intrinsic viscosity | 0.78 |
| terminal carboxy groups | 8.5 milliequivalents/kg |

EXAMPLE 3

A raw material according to Example 1 is processed as described in Example 1. The draw-off speed, however, is 20 m/minute, the total drawing ratio 1 : 6.4 and the shrinkage allowed in the thermosetting operation is 2.7%. The monofilament obtained has the following textile data:

| | |
|---|---|
| diameter | 0.30 mm |
| strength | 71 g/tex |
| elongation at break | 10.4% |
| elongation at the specific load of 27 g/tex | 3.4% |
| shrinkage at 160° C | 6.7% |
| force of shrinkage at 120° C | 300 g |
| intrinsic viscosity | 0.78 |
| terminal carboxy groups | 8.7 milliequivalents/kg |

EXAMPLE 4

A polyethylene terephthalate raw material having an intrinsic viscosity of 0.83 and a content of terminal carboxy groups of 7.0 milliequivalents/kg is spun at 290° C into a water bath by means of a screw extruder, and drawn off at a speed of 7 m/minute. In a further water bath, the monofilament is drawn at 85° C in a ratio of 1 : 5.0, and subsequently drawn at 260° C in an infrared chamber having a length of 7.5 m to attain a total drawing ratio of 1 : 6.6. Subsequently, the monofilament is thermoset at 260° C in a second infrared chamber, while allowing a shrinkage of 1.7%, thus imparting the desired final diameter of 0.40 mm to the monofilament. The monofilament obtained has the following textile data:

| | |
|---|---|
| strength | 70 g/tex |

-continued

| | |
|---|---|
| elongation at break | 10.0 % |
| elongation at the specific load of 27 g/tex | 3.1 % |
| shrinkage at 160° C | 5.1 % |
| force of shrinkage at 120° C | 455 g |
| intrinsic viscosity | 0.78 |
| terminal carboxy groups | 10.7 milliequival./kg |

EXAMPLE 5

A polyethylene terephthalate raw material according to Example is spun as described there. It is drawn in a water bath at 85° C first in a ratio of 1 : 5.0 and subsequently at 260° in an infrared chamber having a length of 7.5 m until a total drawing ratio of 1 : 6.3 is attained. Thermosetting is carried out at 260° C in a second infrared chamber having a length of 7.5 m, while allowing a shrinkage of 2.2%, which confers the desired final diameter of 0.50 mm to the monofilament. The monofilament obtained has the following textile data:

| | |
|---|---|
| strength | 69 g/tex |
| elongation at break | 11.4 % |
| elongation at the specific load of 27 g/tex | 3.3 % |
| shrinkage at 160° C | 5.1 % |
| force of shrinkage at 120° C | 600 g |
| intrinsic viscosity | 0.77 |
| terminal carboxy groups | 10.5 milliequivalents/kg |

What is claimed is:

1. A monofilament of high molecular weight polyethylene terephthalate having an intrinsic viscosity of more than 0.67, a content of terminal carboxy groups of less than 25 milliequivalents/kg, a diameter of from 0.20 to 0.55 mm, a specific strength of more than 60 g/tex, an elongation at break of from 6 to 15%, an elongation at the specific load of 27 g/tex of less than 6%, and a thermoshrinkage measured at 160° C of less than 8%.

* * * * *